United States Patent [19]

Klenk

[11] 4,026,550

[45] May 31, 1977

[54] CONTINUOUS FEEDER

[75] Inventor: Emil Klenk, Murrhardt, Germany

[73] Assignee: Maschinenbau Oppenweiler GmbH, Oppenweiler, Germany

[22] Filed: Jan. 23, 1976

[21] Appl. No.: 651,822

[30] Foreign Application Priority Data

Jan. 24, 1975 Germany ..... 2502790

[52] U.S. Cl. ..... 271/151; 271/38; 271/127

[51] Int. Cl.[2] ..... B65H 1/22

[58] Field of Search ..... 271/3.1, 30 R, 31, 37, 271/38, 126, 127, 151, 152, 171, 185, 186, 225, 275

[56] References Cited

UNITED STATES PATENTS

| | | | |
|---|---|---|---|
| 517,518 | 4/1894 | Dummer | 271/37 |
| 1,591,546 | 7/1926 | Olson | 271/151 |
| 1,898,535 | 2/1933 | Haupt et al. | 271/12 |
| 2,138,995 | 12/1938 | Belloche | 271/38 |

FOREIGN PATENTS OR APPLICATIONS

| | | | |
|---|---|---|---|
| 574,443 | 1/1946 | United Kingdom | 271/37 |
| 392,119 | 5/1933 | United Kingdom | 271/37 |

*Primary Examiner*—Robert W. Saifer
*Attorney, Agent, or Firm*—Wigman & Cohen

[57] ABSTRACT

This disclosure relates to a circular sheet feeding apparatus with a lower loading tray which can be used for loading uneven stacks of sheets, and with a loading and reversing mechanism which carries the uneven stack of sheets in an initial direction underneath a reversing drum, and then around the drum with the help of the drum itself, and into a pick-up tray moving in a second direction. This apparatus is also equipped with an extractor for the removal of the top sheet on the pick-up tray which conveys the sheet in a direction opposite to said second direction.

8 Claims, 2 Drawing Figures

CONTINUOUS FEEDER

BACKGROUND OF THE INVENTION

This invention relates to the sheet feeding art, and more particularly to a circular sheet feeding apparatus that includes a loading tray that can be used for loading uneven stacks of sheets.

In well-known circular sheet feeding devices of the type used with folding machines, the sheets are conveyed by the extractor in a direction over and across the loading tray. The resulting loading tray cover considerably impedes the placing of the stack of sheets on the loading tray, so that in spite of the favorable height of the loading tray, the placing of the stack of sheets on it is rather difficult. Moreover, in one known type of circular sheet feeding apparatus for printing presses, the upper sheet of a stack sitting on the pick-up tray has to be removed perpendicularly to the conveying direction. For sheets with different formats, such a device cannot be used. For this reason it is also not suitable for use with folding machines in which sheets of varying sizes are generally used. Sheets with varying formats, in this feeder, have the same result as the narrow or broad differences of the broad sheet sizes, namely that the top sheet lies in a more or less inclined position and can therefore not be gripped by the extractor in a reliable way.

SUMMARY OF THE INVENTION

In view of the foregoing, it should be apparent that there is still a need in the art for a sheet feeding device which overcomes the aforementioned disadvantages. Accordingly, it is an object of this invention to provide a circular sheet feeding device which, in addition to the favorable height of its loading tray, will permit easy access to same for placing the sheet stacks and with which the top sheet of a stack lying on the pick-up tray can be picked up efficiently, whatever the format and whatever the difference in size, by the extractor. According to one type of circular sheet feeding apparatus of the type mentioned in the introduction, this problem is solved by this invention in that the extractor moves the sheets in the direction opposite to the direction in which the sheets are conveyed to the extractor.

With one such design of the extractor, the sheets picked-up by it are not carried over the loading tray, and can not only be accessed from three different sides, but also from the top since it is not covered. This enables the operator to place the stack of sheets in a more favorable way on the loading tray. Moreover, a more firm grip of the top sheet on the stack by the extractor is ensured in that the extractor can grip the sheet along its edge which is always at the same level, independent from the format of the sheet and the difference in size.

In order to select the thickness of the stack without jeopardizing the position of the zone of the top sheet to be picked-up by the extractor, and keep the length of the pick-up tray to a minimum, a preferred embodiment of this invention provides a reversing drum whose height can be adjusted as desired. Different thicknesses of the stacks can be compensated by adjusting the height of the drum.

The adjustable height of the drum can be achieved in several different ways. The use of a regulator with a device for adjusting the height of the reversing drum to the level desired, and with a guage indicating the height of the front edge of the sheets being picked-up by the extractor, which can consist of two switches corresponding to the different levels, offers certain advantages. The indicator, in such regulators, can give the control point of the top sheet within a given area in the extractor's range, whereby a great stability of the top sheet can easily be obtained. However, it is also possible, for example, to provide a spring which will apply upward pressure on the reversing drum in view of adjusting its height, and a built-in device with fixed setting for the outer side of the stack of sheets to a level higher than the axis of the horizontal position of the reversing drum. Thus, the reversing drum automatically presses downward, as required, against the pressure exerted by the spring. The height adjustment of the reversing drum can be even more precise when the stop element is located where the front edge of the top sheet is released by the conveying mechanism during the operation of the extractor. However, such a built-in device cannot be installed in the area covered by the extractor, which is why the height precision of the top sheet which can be obtained with it is smaller than that obtained with the regulator mentioned.

Advantageously, the end of the top pick-up tray which is adjacent to the reversing drum is at the same height or lower than the opposite end. Thus, the extractor can pick-up the top sheet on a horizontal plane, or on a plane slightly inclined toward the conveying direction, thus providing a very reliable and advantageous method of picking-up the sheets.

In one form of construction which is especially advantageous because of its simplicity, the pick-up tray is mounted in such a way that it can swivel around an axis running in a transverse direction with relation to the transporting or conveying direction of the conveying and reversing devices. Through an inclination of the pick-up tray, the desired level of the top sheet can be maintained even with varying stacks of sheets. If desired, the reversing drum of the pick-up tray can be mounted in such a way that the height adjustment of the reversing drum will automatically lead to an inclination of the pick-up tray.

To permit the use of a reversing drum with an average diameter and the selection of the height for the loading tray and the pick-up tray, based on current requirements, one recommended form of construction provides for the bottom side of the reversing drum to be lower than the bearing surface of the loading tray.

A suction wheel is preferably used as the extractor and is installed with an axis parallel to the axis of the reversing drum, over which the back edge of the top sheet on the pick-up tray, in the second direction, is mounted preferably using a reversing cylinder. This provides for a most reliable operation of the extractor.

With the above and other objects in view that may become apparent hereinafter, the nature of the invention may become more clearly understood by reference to the several views illustrated in the attached drawings, the following detailed description thereof, and the appended claimed subject matter, wherein:

DETAILED DESCRIPTION OF PREFERRED EMBODIMENT

Figure 1:
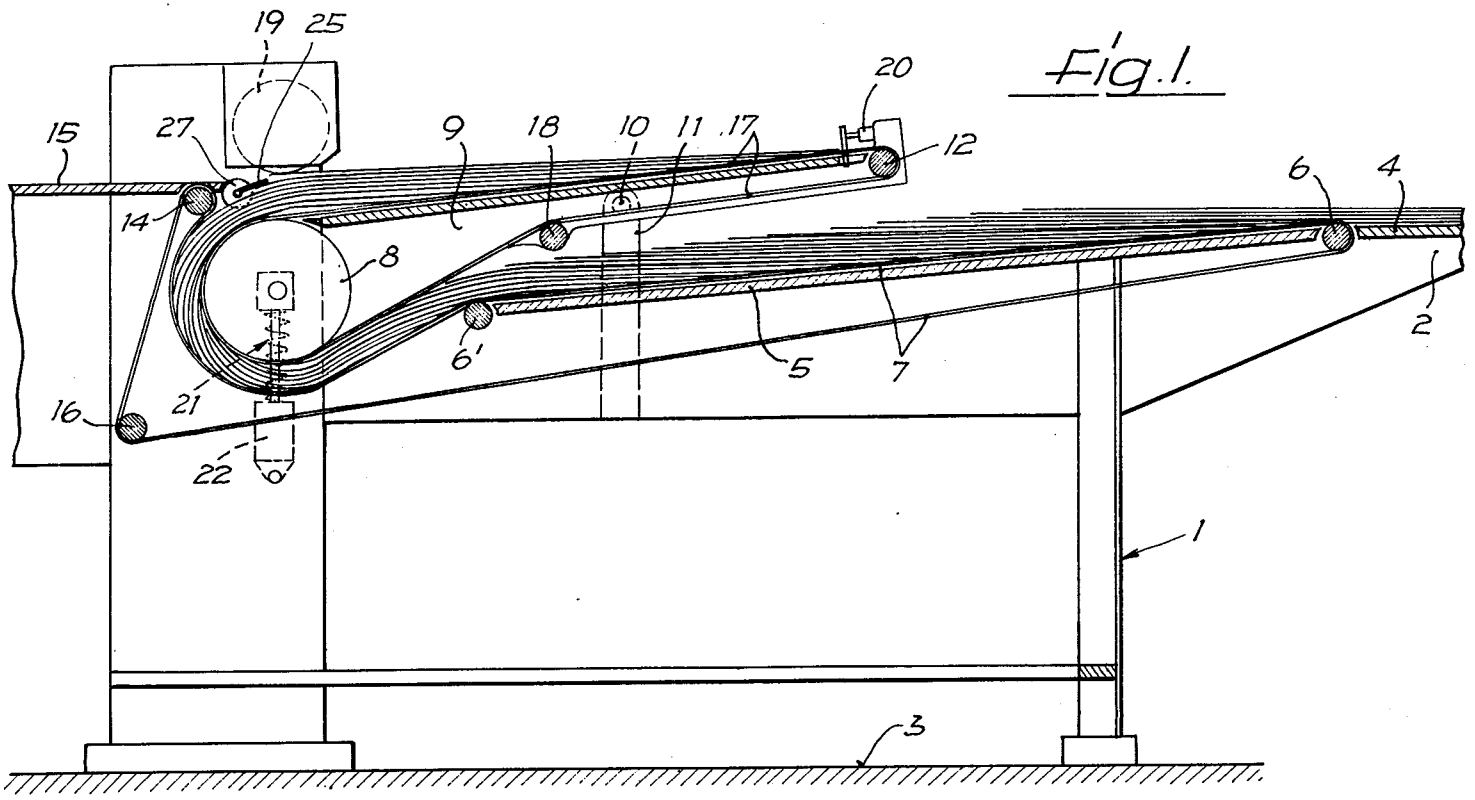
FIG. 1 is a side view of one form of construction of the invention.

Referring now to the drawings in detail, there is illustrated in FIG. 1 a circular sheet feeding apparatus which is intended for the feeding of individual sheets of varying formats into a folding machine, but which can also be used in connection with other types of processing machines. The feeding apparatus includes a frame 1 which is equipped with a projecting loading tray 2. The height of the supporting surface of the loading tray 2 above the ground surface 3 on which the frame 1 stands, as seen in FIG. 1, is preferably 90 cm; however, a higher or lower level could be selected if desired. It is even possible to mount the loading tray 2 on the machine frame 1 in such a way as to permit its height to be adjusted. At the free end of the loading tray 2, the supporting surface consists of a tray 4 of parallel strips separated by a space and aligned with the machine frame 1. A tray 5 whose width, as that of tray 4, is equal to the width of the tray 2, is connected to tray 4 leaving a space between the two of them. The tray 5, as shown in FIG. 1, extends toward a curved end of the loading tray 2 which is opposite the tray 4. The resulting angle, in this form of construction, is approximately 10°. In the space between trays 4 and 5, there is a first guide roller 6 which is installed in such a way that its upper side is coplanar with the surface formed by the upper sides of trays 4 and 5. Several conveyor belts 7 run side-by-side over this roller guide 6, each running independently. The conveyor belts 7 rest on the tray 5 thus forming, on the entire surface of the tray as well as in part of the tray 2, the supporting surface for the sheets to be processed. These sheets are simply placed on the tray 2 in uneven or irregular stacks. On the end of the tray 5, there is mounted a second roller guide 6′ around which the conveyor belts 7 arriving from the tray 5 turn downward. Of course, instead of these roller guides, individual rolls can also be used.

The second roller guide 6′ is mounted on the machine frame 1 opposite a reversing drum 8. The reversing drum 8, whose axis lies parallel to the first roller guide 6 and the second roller guide 6′, has a conventional diameter as far as circular sheet feeding devices are concerned. The drum 8 is mounted so as to rotate at the curved end of the loading tray 2.

A pick-up tray 9 is swivelly mounted in spaced relation from tray 5 and the conveyor belts 7, around an axis 10 parallel to the axis of the reversing drum 8 in the machine frame 1. Side plates 11 for loading the pick-up tray 9 are mounted to the side of tray 5, and thus do not interfere with the conveying of the sheets from the loading tray to the reversing drum 8. The spacing of the pick-up tray 9 from the tray 5 is sufficiently great that even very thick stacks of sheets can be transported therebetween without any obstruction. The extension of the pick-up tray 9 in the direction of the conveyor belt 7 is chosen so that the end which faces the tray 2 and which is formed by a third roller guide 12 is located on an area of the tray 5 which is at a distance of approximately 1 to 1.25 m from the back edge of the tray 4. The opposite end of the pick-up tray 9 is formed by the reversing drum 8. As shown by FIG. 1, the position of the axis 10, around which the pick-up tray 9 swivels, is selected so that the flat surface of the pick-up tray 9 can be adjusted on a horizontal plane or on a descending plane from the third roller guide 12 to the reversing drum 8. However, whatever the position selected for the pick-up tray 9, the bottom side of the reversing drum 8 is always lower than the tray 5.

The conveyor belts 7 which, together with the reversing drum 8 and the related guide rollers 6, 6′, form a part of the conveying and reversing mechanism, following the return, run through the second guide roller 6′, downward to the reversing drum 8, and around it, and then come in contact with the stack of sheets to be reversed, up to the fourth guide roller 14 which has an axis parallel to the axis of the reversing drum 8. The position of the fourth guide roller 14, as shown in FIG. 1, is so chosen that its upper side is just slightly underneath a transportation path 15 over which the individual sheets of a folding machine or any other such machine are carried. The height of the transportation path 15 above the surface 3, according to the preferred embodiment, is approximately 1 m, and is as such adjusted to the height which is required with a folding machine. The fourth guide roller 14 is positioned in relation to the drum 8 in such a manner that the conveyor belts 7 form a sling around the stacks of sheets going around the reversing drum 8, at an angle of nearly 180°.

After the fourth roller guide 14, the conveyor belts 7 run downward, and run over a guide roller 16 from which they once more begin to rise toward the guide roller 6.

Another set of conveyor belts 17 which, like the conveyor belts 7, are spaced side-by-side, run over the third guide roller 12 and the upper side of the pick-up tray 9. After that they encircle the reversing drum 8 at an angle greater than 180°, and run parallel to the section of the conveyor belts 7 between the second guide roller 6′ and the lowest point of the stack. A fifth guide roller 18 which is mounted at a certain distance above the tray 5 leads the conveyor belts 17 toward the third roller guide 12 over a path parallel to the supporting surface of the pick-up tray 9.

The reversing drum 8 is provided with a suction wheel 19 with an axis parallel to the axis of the reversing drum 8, and acting as an extractor. Thus, the suction wheel 19 rotates clockwise, as seen in the FIG. 1, thus enabling it to carry the top sheet lying on the pick-up tray 9 along the transport path 15. The conveying direction of the suction wheel 19 is thus opposite to the second conveying direction, namely the conveying direction of the conveyor belts 17 which also form part of the conveying and reversing mechanism. The suction wheel 19 is controlled using light sensors (not shown).

In view of the foregoing, it should be apparent that the loading tray 2 defines a curved path extending from the tray 4 along the tray 5 in a first conveying direction, then around the drum 8, and then along the tray 9 in a second conveying direction. The wheel 19 thus extracts the sheets from the tray 9 along the transport path 15 in a direction which is opposite to the second conveying direction.

On the end of the pick-up tray 9 facing the loading tray 2, a limit switch 20 is installed which is activated by the front edge of the top sheet transported on the pick-up tray 9, once the back edge zone is underneath the suction wheel 19.

Figure 2:
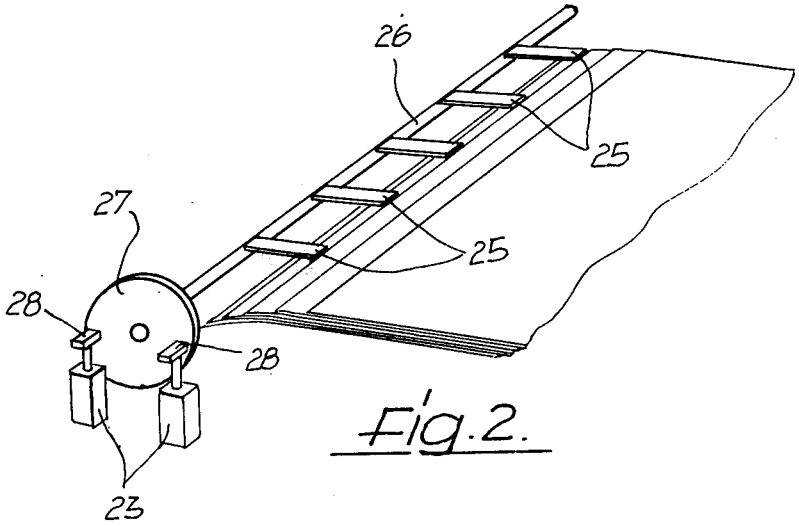
FIG. 2 is a fragmentary perspective view of one section of the height regulator.

In order to ensure that the border zone of the top sheet, which is behind in the conveying direction of the conveyor belts and in the front of the conveying direction of the suction wheel 19, always maintains approximately the same distance from the suction wheel 19, the reversing drum 8 is equipped with a height control regulator 21 which can also be used for the pick-up tray 9 since the latter adopts an inclined position as a result of the height variation of the reversing drum 8. Depending on the rotative direction, the height control mechanism 21 has a motor 22 which shifts the reversing drum 8 upward or downward over a spindle. This motor 22 is controlled by two limit switches 23 (FIG. 2). The level of the sheets is kept as close as possible behind the back edge of the top sheet, in the second conveying direction, near the back border zone of one of the following sheets already released by the conveyor belts 7, by means of blades 25 which are attached to shaft 26, extending parallel to the longitudinal axis of the roller guide 14 in the area between the latter and the suction wheel 19 underneath the transport path 15 of the suction wheel 19, so as to swivel over the frame of the machine. These are installed in such a way that they extend from the shaft 26 across the back edge of the top sheet (see FIG. 2). A disk 27 rests on the outer side of the transport path of the suction wheel, on shaft 26, which has two projections 28 from which either one of the two limit switches 23 can be activated. The two projections 28 and the limit switches 23 are adjusted in such a way that with the angularity of the shaft 26 which corresponds to the largest distance between the sheets and the suction wheel 19, the limit switch which activates the motor 22 by shifting the reversing drum 8 upward is activated. With the angle adjustment which corresponds to the shortest distance between the sheets and the suction wheel, the limit switch 23 which activates the motor 22 in the opposite way is activated. The level of the reversing drum 8 and thus of the top sheet is thus maintained by a two-step controller within the zone of adjustment.

Instead of the preceding type of height control regulator for the reversing drum 8, springs can be used such as those indicated by dotted lines in FIG. 1, which apply upward pressure to the reversing drum 8. Here, the fourth guide roller 14 constitutes a controlling mechanism which limits the height adjustment of the reversing drum 8 depending on the thickness of the stack of sheets passing therebetween.

To facilitate the removal of the top sheet by the suction wheel 19, air jets can be provided at the beginning of the transport path 15 facing the suction wheel 19, which blow underneath the top sheet.

A motor source (not shown) sets the reversing drum 8 in motion, as well as the guide roller 14 and the conveyor belts 7 and 17. The stack of sheets placed on the loading tray 2 is thus transported onto the pick-up tray 9, with the driving gear shutting off instantly the moment the front edge of the top sheet activates the limit switch 20.

Although only a preferred embodiment of the invention has been specifically illustrated and described herein, it is to be understood that minor modifications could be made therein without departing from the spirit of the invention as defined in the appended claims.

I claim:

1. A circular sheet feeding apparatus comprising a lower loading tray for loading and transporting uneven stacks of sheets in a first direction, a rotatable reversing drum for receiving the sheets from said loading tray and conveying them in a second direction, a pick-up tray disposed above said loading tray for receiving sheets conveyed by said reversing drum, means for extracting sheets from said pick-up tray in a direction opposite to said second conveying direction, said loading tray having a first generally-horizontally extending portion and a second portion inclined downwardly from said first portion, said second inclined portion having a leading end and a trailing end, and wherein said first portion of said loading tray and at least said leading end of said second portion are disposed at an elevation above the bottom of said reversing drum.

2. The sheet feeding apparatus, according to claim 1, characterized by means for adjusting the height of the reversing drum.

3. The sheet feeding apparatus according to claim 2, wherein said adjusting means includes a regulator having a height control mechanism for adjusting the height of said reversing drum, and means operatively connected with said regulator for indicating the level of the top one of said sheets in said pick-up tray lying under said extracting means.

4. The sheet feeding apparatus according to claim 2, wherein said adjusting means includes resilient means for applying upward pressure against said reversing drum, and fixed guide means adapted to apply a counter force against said reversing drum through the medium of sheets passing therebetween for providing an upper limit for said height adjustment.

5. The sheet feeding apparatus, according to claim 1, said pick-up tray having a first end adjacent said reversing drum and a second end spaced therefrom, and wherein said first end is at an elevation no higher than that of said second end.

6. The sheet feeding apparatus, according to claim 1, wherein said pick-up tray is rotatable about an axis perpendicular to the direction of movement of the sheets through said apparatus.

7. The sheet feeding apparatus, according to claim 1, wherein said extracting means includes a suction wheel mounted above said pick-up tray and rotatable in the same direction as said reversing drum.

8. The sheet feeding apparatus according to claim 1, wherein said trailing end of said inclined portion has an angle of inclination greater than that of said leading end and extends beneath said reversing drum.

* * * * *